US009429147B2

(12) United States Patent
Suzuki et al.

(10) Patent No.: US 9,429,147 B2
(45) Date of Patent: Aug. 30, 2016

(54) VARIABLE DISPLACEMENT SWASH PLATE COMPRESSOR

(71) Applicant: KABUSHIKI KAISHA TOYOTA JIDOSHOKKI, Kariya-shi, Aichi-ken (JP)

(72) Inventors: Takahiro Suzuki, Kariya (JP); Masaki Ota, Kariya (JP); Shinya Yamamoto, Kariya (JP); Kazunari Honda, Kariya (JP); Kei Nishii, Kariya (JP); Yusuke Yamazaki, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 148 days.

(21) Appl. No.: 14/224,259

(22) Filed: Mar. 25, 2014

(65) Prior Publication Data

US 2014/0294612 A1 Oct. 2, 2014

(30) Foreign Application Priority Data

Mar. 27, 2013 (JP) ..... 2013-067086

(51) Int. Cl.
*F04B 27/10* (2006.01)
*F04B 27/16* (2006.01)
(Continued)

(52) U.S. Cl.
CPC ..... *F04B 1/295* (2013.01); *F04B 27/1072* (2013.01); *F04B 27/18* (2013.01); *F04B 27/1804* (2013.01); *F04B 2027/1813* (2013.01)

(58) Field of Classification Search
CPC ..... F04B 27/10; F04B 27/12; F04B 27/14; F04B 27/16; F04B 27/18; F04B 27/1054; F04B 27/1804; F04B 2027/1813; F04B 2027/1822; F04B 2027/1831
USPC ..... 417/222.1, 222.2, 269, 270
See application file for complete search history.

(56) References Cited

U.S. PATENT DOCUMENTS 4,037,993 A 7/1977 Roberts
4,061,443 A * 12/1977 Black ..... F04B 27/1072 184/6.17
4,174,191 A * 11/1979 Roberts ..... F04B 27/18 417/222.1

(Continued)

FOREIGN PATENT DOCUMENTS

JP 58-162780 A 9/1983
JP 64-041680 A 2/1989

(Continued)

OTHER PUBLICATIONS

Communication dated Jul. 30, 2014, issued by the European Patent Office in counterpart European application No. 14161020.4.

*Primary Examiner* — Peter J Bertheaud
(74) *Attorney, Agent, or Firm* — Sughrue Mion, PLLC

(57) ABSTRACT

A variable displacement swash plate compressor is provided with a housing, a drive shaft, a swash plate, a link mechanism, a piston, a conversion mechanism, an actuator, and a control mechanism. The housing includes a suction chamber, a discharge chamber, a swash plate chamber, and a cylinder bore. The actuator includes a movable body coupled to the swash plate, a fixed body fixed to the drive shaft, and a control pressure chamber defined by the movable body and the fixed body. The movable body includes a circumferential wall extending in a direction along a rotational axis and surrounding the fixed body, which includes a guide portion projecting in an axial direction along an inner surface of the circumferential wall. The movable body contacts the guide portion to restrict inclination of the movable body relative to the drive shaft that is greater than or equal to a predetermined amount.

4 Claims, 6 Drawing Sheets

(51) Int. Cl.
*F04B 27/18* (2006.01)
*F04B 1/29* (2006.01)

(56) References Cited

U.S. PATENT DOCUMENTS 4,963,074 A * 10/1990 Sanuki ..... F04B 27/18 417/222.1
5,022,826 A * 6/1991 Matsuda ..... F04B 27/12 417/222.1
5,032,060 A * 7/1991 Kobayashi ..... F04B 27/12 417/222.1
5,259,736 A * 11/1993 Terauchi ..... F04B 3/106 417/222.1
5,370,503 A * 12/1994 Terauchi ..... F04B 27/1072 417/222.2
5,547,346 A * 8/1996 Kanzaki ..... F04B 49/022 417/222.2
6,142,745 A * 11/2000 Kawaguchi ..... F04B 27/1804 417/222.2
6,217,293 B1 * 4/2001 Murase ..... F04B 27/1804 417/222.2
6,517,321 B1 * 2/2003 Takenaka ..... F04B 27/0895 417/222.1
6,742,439 B2 6/2004 Matsuda et al.
2012/0073430 A1 3/2012 Uchikado

FOREIGN PATENT DOCUMENTS

JP 01-147171 A 6/1989
JP 02-016374 A 1/1990
JP 02-019665 A 1/1990
JP 3-10082 U 1/1991
JP 04-054287 A 2/1992
JP 05-018355 A 1/1993
JP 2007-239722 A 9/2007

* cited by examiner

VARIABLE DISPLACEMENT SWASH PLATE COMPRESSOR

BACKGROUND OF THE INVENTION

The present invention relates to a variable displacement swash plate compressor.

Japanese Laid-Open Patent Publication No. 5-172052 and Japanese Laid-Open Patent Publication No. 52-131204 each disclose a variable displacement swash plate compressor (hereinafter referred to as compressor). Each compressor is provided with a housing including a suction chamber, a discharge chamber, a swash plate chamber, and a plurality of cylinder bores. The housing rotatably supports a drive shaft. The swash plate chamber accommodates a swash plate, which is rotated when the drive shaft rotates. A link mechanism is arranged between the drive shaft and the swash plate to change an inclination angle of the swash plate. The inclination angle is an angle relative to a direction orthogonal to the rotation axis of the drive shaft. A piston accommodated in each cylinder bore reciprocates and forms a compression chamber in the cylinder bore. When the swash plate rotates, a conversion mechanism reciprocates the piston in each cylinder bore with a stroke corresponding to the inclination angle. A control mechanism controls an actuator to change the inclination angle.

In the compressor of Japanese Laid-Open Patent Publication No. 5-172052, a pressure adjustment chamber is formed in a rear housing segment of the housing. Further, a control pressure chamber that is in communication with the pressure adjustment chamber is formed in a cylinder block of the housing. The actuator is arranged in the control pressure chamber so as not to rotate integrally with the drive shaft. Specifically, the actuator includes a non-rotation movable body that covers a rear end of the drive shaft. An inner surface of the non-rotation movable body supports the rear end of the drive shaft so that the drive shaft is rotatable relative to the non-rotation movable body and movable in the axial direction. An outer surface of the non-rotation movable body is movable in the axial direction in the control pressure chamber but not about the rotation axis. A pushing spring is arranged in the control pressure chamber to urge the non-rotation movable body toward the front. The actuator includes a movable body that is coupled to the swash plate and movable in the axial direction. A thrust bearing is provided between the non-rotational movable body and the movable body. A pressure control valve is arranged between the pressure adjustment chamber and the discharge chamber to change the pressure in the control pressure chamber and move the non-rotation movable body and the movable body in the axial direction.

The link mechanism includes a movable body and a lug arm, which is fixed to the drive shaft. The rear end of the lug arm includes an elongated hole that extends toward the rotation axis from the outer side in a direction orthogonal to the rotation axis. A pin is inserted into the elongated hole to support the front side of the swash plate so that the front side is tiltable about a first tilt axis. The front end of the movable body includes an elongated hole that extends toward the rotation axis from the outer side in a direction orthogonal to the rotation axis. A pin is inserted to the elongated hole to support the rear side of the swash plate so that the rear side is tiltable about a second tilt axis, which is parallel to the first tilt axis.

In the compressor, the pressure adjustment valve is controlled to open and connect the discharge chamber and the pressure adjustment chamber so that the pressure of the control pressure chamber becomes higher than the pressure of the swash plate chamber. This moves the non-rotation movable body and the movable body forward. As a result, the inclination angle of the swash plate increases, and the stroke of the pistons increases. The compressor displacement of the compressor for each drive shaft rotation also increases. When the pressure adjustment valve is controlled to close and disconnect the discharge chamber and the pressure adjustment chamber, the pressure of the control pressure chamber decreases to the same level as the pressure in the swash plate chamber. This moves the non-rotation movable body and the movable body rearward. As a result, the inclination angle of the swash plate decreases, and the stroke of the pistons decreases. The compressor displacement of the compressor for each drive shaft rotation also decreases.

In the compressor disclosed in Japanese Laid-Open Patent Publication No. 52-131204, an actuator is arranged in the swash plate chamber and rotated integrally with the drive shaft. Specifically, the actuator includes a fixed body fixed to a drive shaft. A movable body that moves in the axial direction and is movable relative to the fixed body is accommodated in the fixed body. A control pressure chamber that moves the movable body with the interior pressure is defined between the fixed body and the movable body. A communication passage, which is connected to the control pressure chamber, extends through the drive shaft. The pressure control valve is arranged between the communication passage and the discharge chamber. The pressure control valve changes the pressure in the control pressure chamber to move the movable body in the axial direction relative to the fixed body. The rear end of the movable body is in contact with a hinge ball. The hinge ball is couple to the swash plate so that the hinge ball is tiltable. A pushing spring urges the rear end of the hinge ball in a direction that increases the inclination angle.

The link mechanism includes the hinge ball and the link, which is arranged between the fixed body and the swash plate. A pin, which extends in a direction orthogonal to the rotation axis, is fitted to the front end of the link. A pin, which extends in a direction orthogonal to the rotation axis, is fitted to the rear end of the link. The link and the two pins tiltably support the swash plate.

In the compressor, the pressure adjustment valve is controlled and open to connect the discharge chamber and the pressure adjustment chamber so that the interior of the control pressure chamber has a higher pressure than the swash plate chamber. This moves the movable body toward the rear, decreases the inclination angle of the swash plate, and decreases the stroke of the pistons. The compressor displacement per one rotation of the compressor also becomes small. On the other hand, if the pressure adjustment valve is close controlled to non-connect the discharge chamber and the pressure adjustment chamber, the interior of the control pressure chamber becomes a low pressure of the same extent as the swash plate chamber. The movable body thereby moves forward. The inclination angle of the swash plate thus becomes large, and the stroke of the piston increases. This increases the compressor displacement for each drive shaft rotation of the compressor.

In the compressors described above, a portion of the actuator easily inclines relative to the rotation axis when the suction reaction force and a compression reaction force of the pistons act on the actuator through the swash plate, the link mechanism, and the like. This adversely affects the operation of the actuator in such compressors and the control for varying the compressor displacement.

SUMMARY OF THE INVENTION

It is an object of the present invention to provide a variable displacement swash plate compressor that has superior controllability when changing the compressor displacement.

To achieve the above object, one aspect of the present invention is a variable displacement swash plate compressor provided with a housing including a suction chamber, a discharge chamber, a swash plate chamber, and a cylinder bore. A drive shaft is supported to be rotatable in the housing. A swash plate is rotatable in the swash plate chamber when the drive shaft rotates. A link mechanism is arranged between the drive shaft and the swash plate. The link mechanism allows an inclination angle of the swash plate to be changed relative to a direction orthogonal to a rotation axis of the drive shaft. A piston is reciprocated in the cylinder bore. A conversion mechanism reciprocates the piston in the cylinder bore with a stroke corresponding to the inclination angle when the swash plate rotates. An actuator is capable of changing the inclination angle. A control mechanism controls the actuator. The actuator is arranged in the swash plate chamber to be rotatable integrally with the drive shaft. The actuator includes a movable body coupled to the swash plate, a fixed body fixed to the drive shaft, and a control pressure chamber defined by the movable body and the fixed body. The drive shaft is inserted into the movable body to allow movement of the movable body in an axial direction. The actuator is configured to move the movable body with an interior pressure of the control pressure chamber. The movable body includes a circumferential wall that extends in a direction along the rotational axis and surrounds the fixed body. The fixed body includes a guide portion that projects in the direction along the rotational axis and extends along an inner surface of the circumferential wall. The movable body contacts the guide portion to restrict inclination of the movable body relative to the drive shaft that is greater than or equal to a predetermined amount.

In the compressor of the present invention, the actuator includes the movable body, the fixed body, and the control pressure chamber, and the circumferential wall is formed in the movable body. The circumferential wall extends in the axial direction and surrounds the fixed body. The fixed body includes the guide portion that projects in the axial direction along the inner surface of the circumferential wall. Thus, in the compressor, even if the suction reaction force and the compression reaction force acting on the piston is transmitted to the actuator through the swash plate and the link mechanism, contact of the movable body with the guide portion moves the movable body in the axial direction while restricting inclination of the movable body relative to the drive shaft over a predetermined amount or greater. Thus, in the compressor, the actuator is easily operated in a suitable manner, and the controllability for varying the compressor displacement is improved.

Accordingly, the compressor of the present invention has superior controllability when varying the compressor displacement. Thus, in the compressor, the compressor displacement can be rapidly changed by an input to the control mechanism, and improvement in the responsiveness of the capacity control can be expected. Further, in the compressor, it can be expected that excellent durability can be obtained even when the compressor displacement is frequently varied.

The guide portion may be formed integrally with the fixed body. Alternatively, the guide portion may be formed discretely from the fixed body and then be coupled to the fixed body. Further, the guide portion may be formed from the same material as the movable body and the fixed body. Alternatively, the guide portion may be formed from a material differing from that of the movable body and the fixed body.

The guide portion only needs to be projected in the axial direction. For example, the guide portion may be formed to project toward the control pressure chamber from the fixed body.

Preferably, the fixed body includes a main body portion including a first surface and a second surface. The first surface is located closer to the swash plate, and the second surface is located closer to the control pressure chamber. The guide portion projects toward the swash plate from the first surface of the main body portion.

In this case, the guide portion does not project into the control pressure chamber. Thus, the control pressure chamber and, consequently, the compressor may be reduced in size while obtaining sufficient volume for the control pressure chamber.

Preferably, the movable body includes a coupling portion that projects toward the swash plate and is coupled to the swash plate. The guide portion is located in the fixed body at an area excluding an area corresponding to the coupling portion.

In this case, the swash plate and the movable body are easily coupled by the coupling portion. Compression reaction force and torque easily concentrate at the coupling portion through the swash plate. This would easily deform the coupling portion. Thus, if the guide portion is formed in an area corresponding to the coupling portion, deformation of the coupling portion would increase the resistance between the coupling portion and the guide portion and make it difficult to move the movable body. In this respect, the guide portion is formed in an area excluding the area corresponding to the coupling portion in the compressor. Thus, even if deformation occurs in the coupling portion, the guide portion is not affected. This allows for the movable body to move in a suitable manner.

The guide portion may have any of various shapes as long as it has a shape that projects in the axial direction along the inner surface of the circumferential wall of the movable body. For example, the guide portion may be formed to have the form of a rod or a plate.

Preferably, the guide portion is flanged. The guide portion has a projection length that is maximal at a portion of the fixed body located farthest from the coupling portion. The projection length gradually decreases toward the coupling portion.

In this case, the influence when the coupling portion is deformed can be reduced while increasing the area of contact between the inner surface of the circumferential wall and the guide portion.

Preferably, a slide layer is applied to at least one of the inner surface of the circumferential wall and the guide portion to reduce slide resistance.

In this case, the movable body may be moved in a further suitable manner. Further, the durability of the movable body and the guide portion may be improved by reducing the slide resistance. The slide layer may be formed, for example, by applying tin plating to the inner surface of the circumferential wall and the guide portion. Further, the slide layer may also be formed by applying fluorine resin or the like to the inner surface of the circumferential wall and the guide portion. Moreover, if the movable body and the guide portion are made of aluminum alloy, alumite processing may be performed on the movable body and guide portion to form the slide layer.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of the present invention will now be described with reference to the drawings. A compressor of the present embodiment is a variable displacement double-headed swash plate compressor. The compressor is installed in a vehicle and forms a refrigeration circuit of a vehicle air conditioner.

Figure 1:
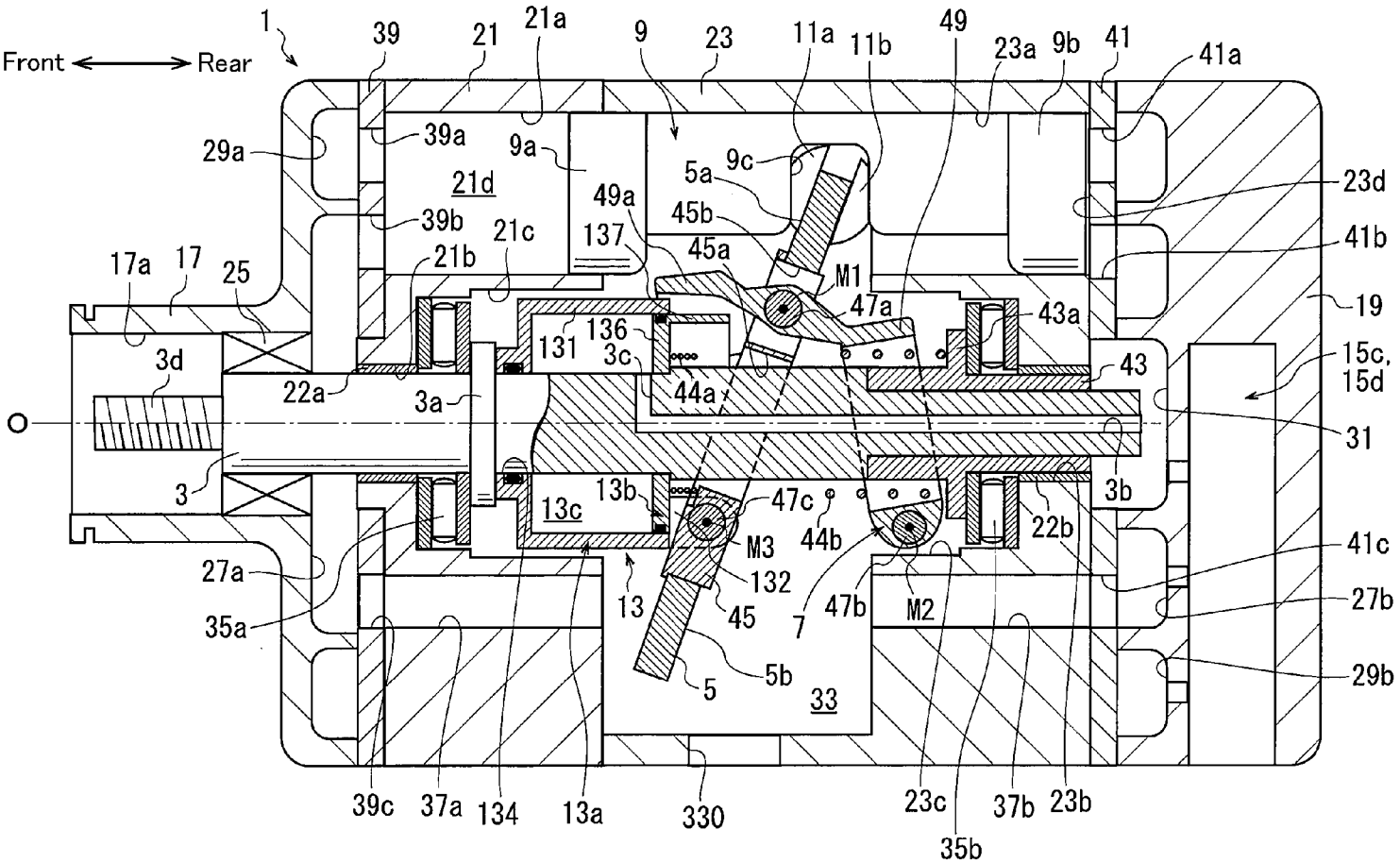
FIG. 1 is a cross-sectional view of a compressor according to one embodiment of the present invention when the compressor displacement is maximal.
Figure 2:
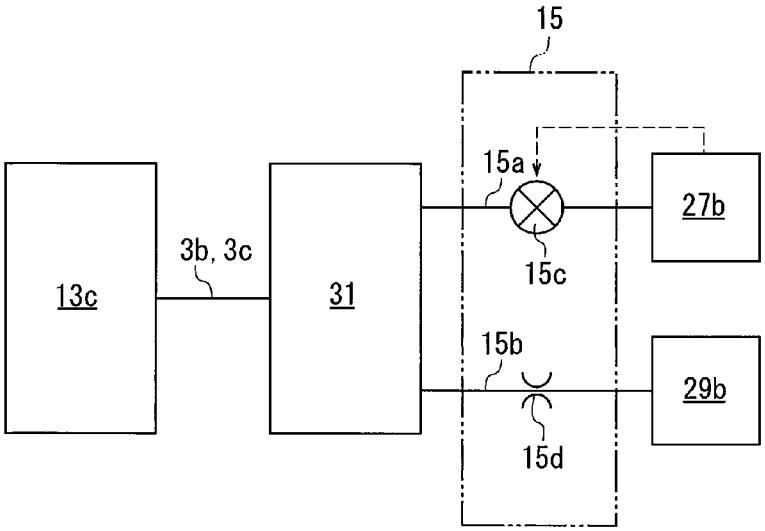
FIG. 2 is a schematic view of a control mechanism for the compressor shown in FIG. 1.

As shown in FIG. 1, the compressor includes a housing 1, a drive shaft 3, a swash plate 5, a link mechanism 7, a plurality of pistons 9, pairs of shoes 11*a* and 11*b*, an actuator 13, and a control mechanism 15, which is shown in FIG. 2. In FIG. 1, the shape of the actuator 13 and the like is simplified to facilitate illustration. The same applies to FIG. 3.

As shown in FIG. 1, the housing 1 includes a front housing segment 17, which is located at the front of the compressor, a rear housing segment 19, which is located at the rear of the compressor, and a first cylinder block 21 and a second cylinder block 23, which are located between the front housing segment 17 and the rear housing segment 19.

A boss 17*a* extends toward the front from the front housing segment 17. A shaft seal device 25 is located in the boss 17*a* between the boss 17*a* and the drive shaft 3. A first suction chamber 27*a* and a first discharge chamber 29*a* are formed in the front housing segment 17. The first suction chamber 27*a* is located at the radially inner side of the front housing segment 17, and the first discharge chamber 29*a* is located at the radially outer side of the front housing segment 17.

The control mechanism 15 is arranged in the rear housing segment 19. A second suction chamber 27*b*, a second discharge chamber 29*b*, and a pressure adjustment chamber 31 are formed in the rear housing segment 19. The second suction chamber 27*b* is located at the radially inner side of the rear housing segment 19, and the second discharge chamber 29*b* is located at the radially outer side of the rear housing segment 19. The pressure adjustment chamber 31 is located at the central portion of the rear housing segment 19. A discharge passage (not shown) connects the first discharge chamber 29*a* and the second discharge chamber 29*b*. The discharge passage includes a discharge port (not shown), which connects the discharge passage to the outer side of the compressor.

A swash plate chamber 33 is formed between the first cylinder block 21 and the second cylinder block 23. The swash plate chamber 33 is located at the middle portion of the housing 1 with respect to the longitudinal direction of the compressor.

The first cylinder block 21 includes parallel first cylinder bores 21*a* arranged at equal angular intervals. The first cylinder block 21 also includes a first shaft hole 21*b*, into which the drive shaft 3 is fitted. A first slide bearing 22*a* is arranged in the first shaft hole 21*b*. A rolling bearing may be arranged in place of the first slide bearing 22*a*.

The first cylinder block 21 includes a first recess 21*c*, which is connected to the first shaft hole 21*b* and coaxial with the first shaft hole 21*b*. The first recess 21*c* is also connected to the swash plate chamber 33. The first recess 21*c* is shaped so that the diameter of the first recess 21*c* decreases in a stepped manner toward the front end. A first thrust bearing 35*a* is arranged at the front end of the first recess 21*c*. Further, the first cylinder block 21 includes a first suction passage 37*a*, which connects the swash plate chamber 33 and the first suction chamber 27*a*.

In the same manner as the first cylinder block 21, the second cylinder block 23 includes second cylinder bores 23*a*. Each second cylinder bore 23*a* is paired with one of the first cylinder bores 21*a*, which the first cylinder bore 21*a* located at the front side and the second cylinder bore 23*a* located at the rear side. The second cylinder block 23 also includes a second shaft hole 23*b*, into which the drive shaft 3 is fitted. The second shaft hole 23*b* is connected to the pressure adjustment chamber 31. A second slide bearing 22*b* is arranged in the second shaft hole 23*b*. A rolling bearing may be arranged in place of the second slide bearing 22*b*.

The second cylinder block 23 also includes a second recess 23*c*, which is connected to the second shaft hole 23*b* and coaxial with the second shaft hole 23*b*. The second recess 23*c* is also connected to the swash plate chamber 33. The second recess 23*c* is shaped so that the diameter of the second recess 23*c* decreases in a stepped manner toward the rear end. A second thrust bearing 35*b* is arranged at the rear end of the second recess 23*c*. Further, the second cylinder block 23 includes a second suction passage 37*b* that connects the swash plate chamber 33 and the second suction chamber 27*b*.

Further, the second cylinder block 23 includes a suction port 330 connecting the swash plate chamber 33 to an evaporator (not shown).

A first valve plate 39 is arranged between the front housing segment 17 and the first cylinder block 21. The first valve plate 39 includes suction ports 39*b* and discharge ports 39*a*, the numbers of which is the same as the number of the first cylinder bores 21*a*. A suction valve mechanism (not shown) is arranged in each suction port 39*b* to connect the corresponding first cylinder bore 21*a* with the first suction chamber 27*a* through the suction port 39*b*. A discharge valve mechanism (not shown) is arranged in each discharge port 39*a* to connect the corresponding first cylinder bore 21*a* to the first discharge chamber 29*a* through the discharge port 39*a*. The first valve plate 39 also includes a communication hole 39*c* that connects the first suction chamber 27*a* and the first suction passage 37*a*.

A second valve plate 41 is arranged between the rear housing segment 19 and the second cylinder block 23. In the same manner as the first valve plate 39, the second valve plate 41 includes suction ports 41*b* and discharge ports 41*a*, the numbers of which are the same as number of the second cylinder bores 23*a*. A suction valve mechanism (not shown) is arranged in each suction port 41*b* to connect the corresponding second cylinder bore 23*a* with the second suction chamber 27*b* through the suction port 41*b*. A discharge valve mechanism (not shown) is arranged in each discharge port 41*a* to connect the corresponding second cylinder bore 23*a* to the second discharge chamber 29*b* through the discharge port 41*a*. The second valve plate 41 also includes a communication hole 41*c* that connects the second suction chamber 27*b* and the second suction passage 37*b*.

The first and second suction passages 37*a* and 37*b* and the communication holes 39*c* and 41*c* connect the first and second suction chambers 27*a* and 27*b* to the swash plate chamber 33. This substantially equalizes the pressure in the first and second suction chambers 27*a* and 27*b* with the pressure in the swash plate chamber 33. Refrigerant gas that passes through the evaporator and flows into the swash plate chamber 33 through the suction port 330 causes the pressure in the swash plate chamber 33 and the first and second suction chambers 27*a* and 27*b* to be lower than the pressure in the first and second discharge chambers 29*a* and 29*b*.

The swash plate 5, the actuator 13, and a flange 3*a* are each coupled to the drive shaft 3. The drive shaft 3 extends toward the rear from the boss 17*a* and is fitted into the first and second slide bearings 22*a* and 22*b*. This supports the drive shaft 3 rotatably about the rotation axis O. The drive shaft 3 has a front end located in the boss 17*a* and a rear end located in the pressure adjustment chamber 31. The swash plate 5, the actuator 13, and the flange 3*a* are each arranged in the swash plate chamber 33. The flange 3*a* is arranged between the first thrust bearing 35*a* and the actuator 13.

A support 43 is press-fitted to the rear end of the drive shaft 3. The support 43 includes a flange 43*a*, which contacts the second thrust bearing 35*b*, and a coupling portion (not shown), into which a second pin 47*b* is fitted. Further, the rear end of a second recovery spring 44*b* is fixed to the support 43. The second recovery spring 44*b* extends toward the swash plate chamber 33 from the support 43 in the direction of axis O.

The drive shaft 3 includes an axial passage 3*b*, which extends in the direction of axis O from the rear end toward the front, and a radial passage 3*c*, which extends in the radial direction from the front end of the axial passage 3*b* and opens in the outer surface of the drive shaft 3. The axial passage 3*b* and the radial passage 3*c* form a communication passage. The rear end of the axial passage 3*b* opens in the pressure adjustment chamber 31. The radial passage 3*c* opens in the control pressure chamber 13*c*.

A threaded portion 3*d* is formed at the distal end of the drive shaft 3. A pulley or an electromagnetic clutch (not shown) is coupled to the threaded portion 3*d* and connected to the drive shaft 3. A belt (not shown), which is driven by the engine of the vehicle, runs along the pulley or the pulley of the electromagnetic clutch.

The swash plate 5, which is annular and flat, includes a front surface 5*a* and a rear surface 5*b*. The front surface 5*a* faces the front side of the compressor in the swash plate chamber 33. The rear surface 5*b* faces the rear side of the compressor in the swash plate chamber 33. The swash plate 5 is fixed to a ring plate 45. An insertion hole 45*a* extends through the central portion of the ring plate 45, which is annular and flat. The swash plate 5 is coupled to the drive shaft 3 in the swash plate chamber 33 by inserting the drive shaft 3 through the insertion hole 45*a*.

Figure 3:
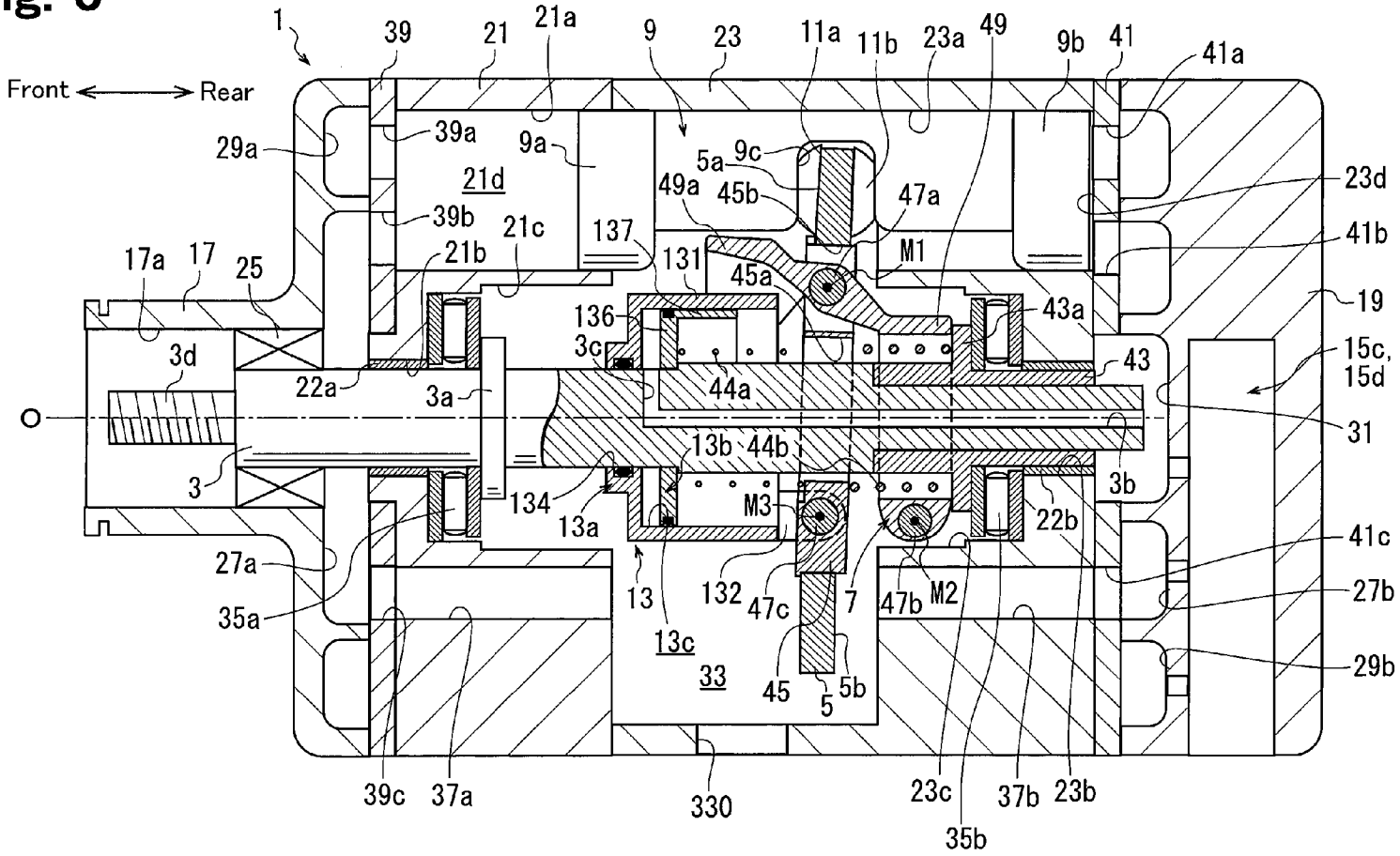
FIG. 3 is a cross-sectional view of the compressor shown in FIG. 1 when the compressor displacement is minimal.

The link mechanism 7 includes a lug arm 49 located toward the rear of the swash plate 5 between the swash plate 5 and the support 43 in the swash plate chamber 33. The lug arm 49 is formed to be substantially L-shaped as viewed from the front end toward the rear end. As shown in FIG. 3, the lug arm 49 contacts the flange 43*a* of the support 43 when the inclination angle of the swash plate 5 is minimal relative to the rotation axis O. The lug arm 49 allows the swash plate 5 to be maintained at a minimum inclination angle in the compressor. A weight 49*a* is formed at the front end of the lug arm 49. The weight 49*a* extends around substantially one half of the actuator 13 in the circumferential direction. The weight 49*a* may be designed to have a suitable shape.

A first pin 47*a* connects the front end of the lug arm 49 to one radial side of the ring plate 45. This supports one end of the lug arm 49 to be tiltable about the axis of the first pin 47*a*, or the first tilt axis M1, relative to one side of the ring plate 45, that is, the swash plate 5. The first tilt axis M1 extends in a direction orthogonal to the rotation axis O of the drive shaft 3.

The second pin 47*b* connects the rear end of the lug arm 49 to the support 43. This support the other end of the lug arm 49 to be tiltable about the axis of the second pin 47*b*, or the second tilt axis M2, relative to the support 43, that is, the drive shaft 3. The second tilt axis M2 extends parallel to the first tilt axis M1. The lug arm 49 and the first and second pins 47*a* and 47*b* form the link mechanism 7 of the present invention.

The weight 49*a* is arranged to extend from one end of the lug arm 49, or the first tilt axis M1, toward the side opposite to the second tilt axis M2. The lug arm 49 is supported by the ring plate 45 with the first pin 47*a* so that the weight 49*a* extends through a groove 45*b* of the ring plate 45 and is located on the front surface of the ring plate 45, that is, the front surface 5*a* of the swash plate 5. The centrifugal force generated when the swash plate 5 rotates about the rotation axis O acts on the weight 49*a* at the front surface 5*a* of the swash plate 5.

In the compressor, the link mechanism 7 connects the swash plate 5 and the drive shaft 3 so that the swash plate 5 is rotatable with the drive shaft 3. The two ends of the lug arm 49 are respectively tilted about the first tilt axis M1 and the second tilt axis M2 to change the inclination angle of the swash plate 5.

Each piston 9 includes a first piston head 9*a*, which is formed on the front end, and a second piston head 9*b*, which is formed on the rear end. The first piston head 9*a* reciprocates in the first cylinder bore 21*a* and forms a first compression chamber 21*d*. The second piston head 9*b* reciprocates in the second cylinder bore 23*a* and forms a second compression chamber 23*d*. A piston recess 9*c* is formed in the middle of each piston 9. Each piston recess 9*c* accommodates a pair of the semispherical shoes 11*a* and 11*b* to convert the rotation of the swash plate 5 to reciprocation of the piston 9. The shoes 11*a* and 11*b* form the conversion mechanism of the present invention. The first and second piston heads 9*a* and 9*b* respectively reciprocate in the first and second cylinder bores 21*a* and 23*a* with a stroke corresponding to the inclination angle of the swash plate 5.

Figure 4A:
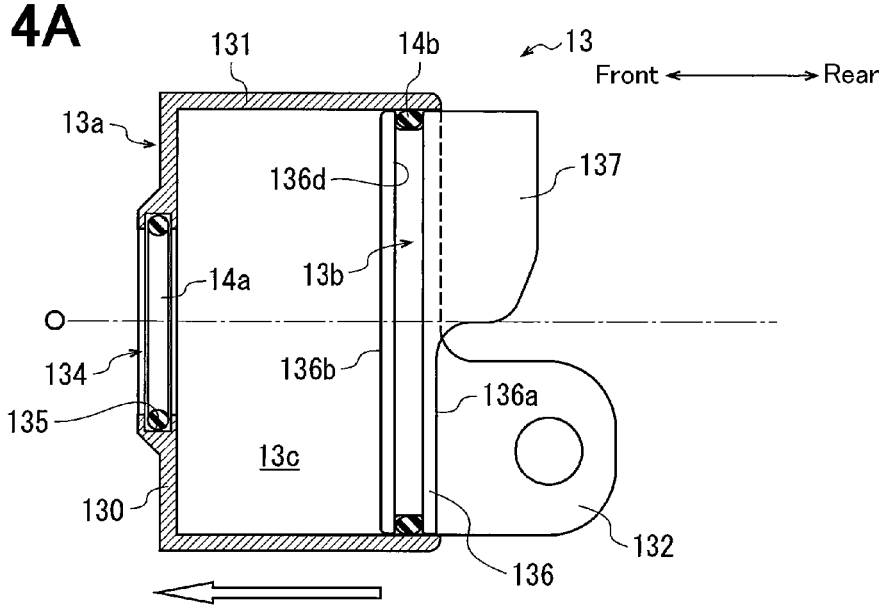
FIG. 4A is an enlarged cross-sectional view of an actuator of the compressor shown in FIG. 1 when a movable body is moved toward the rear side along a rotation axis.
Figure 4B:
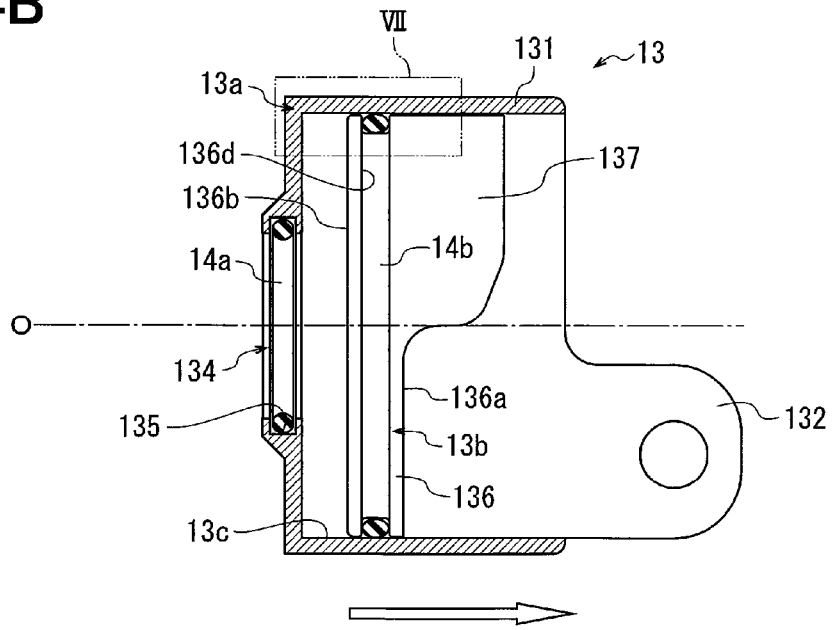
FIG. 4B is an enlarged cross-sectional view of the actuator of the compressor of FIG. 1 showing a state in which the movable body is moved toward a front side along the rotation axis.

The actuator 13 is arranged in the swash plate chamber 33, located in front of the swash plate 5, and movable into the first recess 21*c*. As shown in FIGS. 4A and 4B, the actuator 13 includes a movable body 13*a*, a fixed body 13*b*, and a control pressure chamber 13*c*. The control pressure chamber 13*c* is formed between the movable body 13*a* and the fixed body 13*b*.

Figure 5:
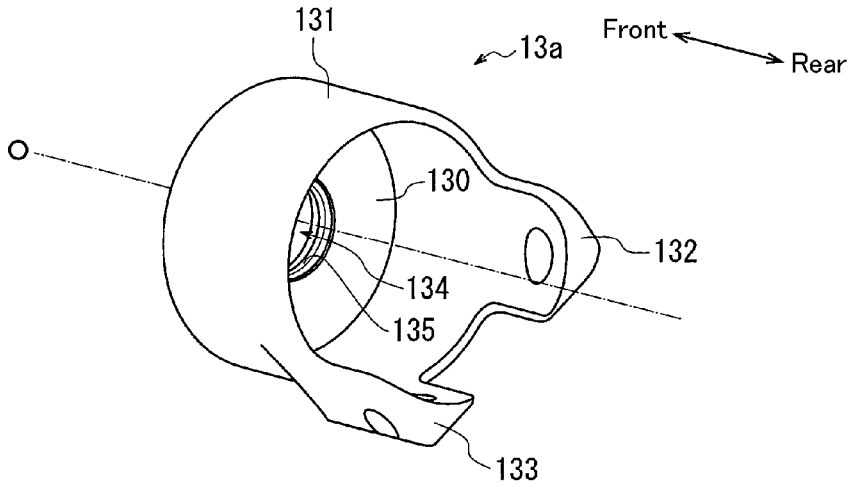
FIG. 5 is a perspective view of the movable body of the compressor of FIG. 1 seen from the rear side.

As shown in FIG. 5, the movable body 13*a* includes a front wall 130, a circumferential wall 131, and coupling portions 132 and 133. The front wall 130 radially extends away from the rotation axis O. An insertion hole 134 extends through the front wall 130, and a ring groove 135 is formed in the wall of the insertion hole 134. As shown in FIGS. 4A and 4B, an O-ring 14*a* is received in the ring groove 135. The drive shaft 3 is not shown in FIGS. 4A and 4B to facilitate the illustration.

As shown in FIG. 5, the circumferential wall 131 is continuous with the outer edge of the front wall 130 and extends toward the rear. Each of the coupling portions 132 and 133 is continuous with the rear end of the circumferential wall 131 and located on the other end of the movable body 13*a*. Each of the coupling portions 132 and 133 further projects toward the rear of the movable body 13*a* from the rear end of the circumferential wall 131, that is, projects toward the swash plate 5 from the rear end of the circumferential wall 131. The movable body 13*a*, which is cylindrical and has a closed end, includes the front wall 130, the circumferential wall 131, and the coupling portions 132 and 133.

Figure 6:
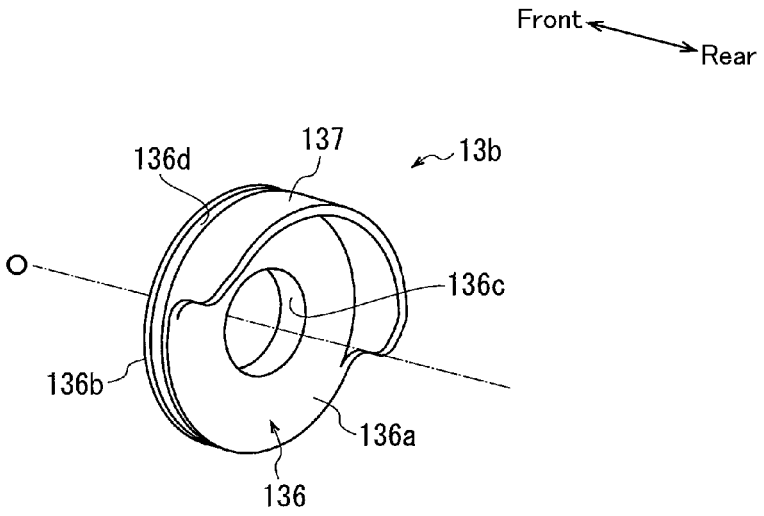
FIG. 6 is a perspective view of a fixed body of the compressor of FIG. 1 seen from the rear side.

As shown in FIG. 6, the fixed body 13*b* includes a main body portion 136 and a guide portion 137. The main body portion 136 has the form of a circular plate and has substantially the same diameter as the inner diameter of the movable body 13*a*. The main body portion 136 includes a rear surface 136*a* and a front surface 136*b*. The rear surface 136*a* is closer to the swash plate 5, and the front surface 136*b* is closer to the control pressure chamber 13*c*. The rear surface 136*a* corresponds to a first surface in the present invention, and the front surface 136*b* corresponds to a second surface in the present invention. An insertion hole 136*c* extends through the center of the main body portion 136. Further, a ring groove 136*d* is formed in the circumferential surface of the main body portion 136. As shown in FIGS. 4A and 4B, an O-ring 14*b* is received in the ring groove 136*d*.

The guide portion 137 is formed integrally with the main body portion 136 and projects toward the swash plate 5 from the rear surface 136*a* of the main body portion 136.

As shown in FIG. 6, the guide portion 137 extends along the circumference of the main body portion 136 at one radial side of the main body portion 136. The guide portion 137 is formed over substantially one half of the circumference of the rear surface 136*a* at one side in the radial direction. The guide portion 137 is shaped so that a projection length is maximal at a portion located at one end of the main body portion 136, and the projection length gradually decreases toward the other end of the main body portion 136. The guide portion 137 thus has the form of a substantially semicircular flange projecting from the rear surface 136*a*.

Further, the guide portion 137 is shaped along the circumference of the main body portion 136 to extend along the inner surface of the circumferential wall 131 of the movable body 13*a*, as shown in FIGS. 4A and 4B. Thus, the inner surface of the circumferential wall 131 of the movable body 13*a* is in contact with the circumference of the main body portion 136 and the guide portion 137.

Figure 7:
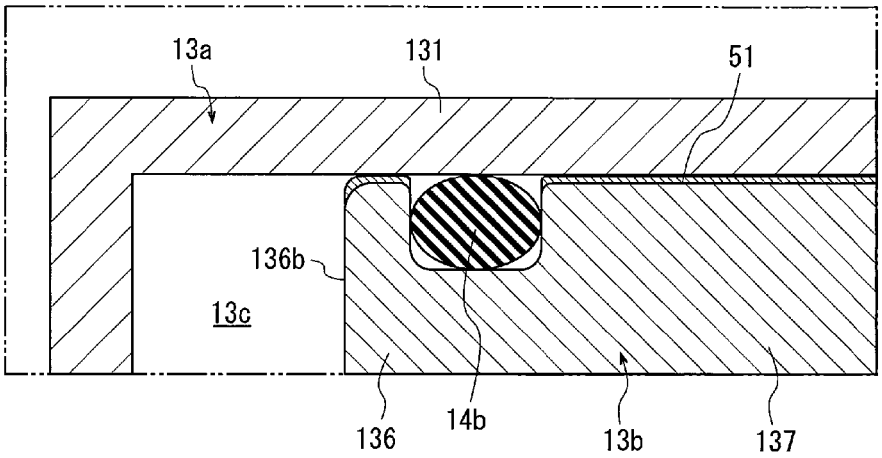
FIG. 7 is an enlarged cross-sectional view showing the main parts of FIG. 4B.

As shown in FIG. 7, a slide layer 51, which is formed by a tin plating, is applied to the outer surface of the main body portion 136 and the outer surface of the guide portion 137.

As shown in FIG. 1, the drive shaft 3 is inserted into the movable body 13*a* and the fixed body 13*b* through the insertion holes 134 and 136*c*. The movable body 13*a* and the link mechanism 7 are arranged on opposite sides of the swash plate 5. The fixed body 13*b* is arranged in the movable body 13*a* in front of the swash plate 5 and surrounded by the circumferential wall 131. Thus, the control pressure chamber 13*c* is formed between the movable body 13*a* and the fixed body 13*b*. The control pressure chamber 13*c* is surrounded by the circumferential wall 131, and is separated from the swash plate chamber 33 by the fixed body 13*b* and the front wall 130 and the circumferential wall 131 of the movable body 13*a*. As described above, the radial passage 3*c* is open to the control pressure chamber 13*c*, and the control pressure chamber 13*c* is connected to the pressure adjustment chamber 31 through the radial passage 3*c* and the axial passage 3*b*.

When the drive shaft 3 is fitted to the movable body 13*a*, the movable body 13*a* is rotatable with the drive shaft 3 and movable in the direction of axis O of the drive shaft 3 in the swash plate chamber 33.

The fixed body 13*b*, when fitted to the drive shaft 3, is fixed to the drive shaft 3. In this case, as shown in FIGS. 4A and 4B, the fixed body 13*b* is fixed to the drive shaft 3 with the coupling portion 132 and 133 of the movable body 13*a* arranged at one end of the fixed body 13*b*. Thus, the fixed body 13*b* is able to rotate only with the drive shaft 3 but cannot move like the movable body 13*a*.

The guide portion 137 is formed over substantially one half the circumference of one end of the rear surface 136*a* of the main body portion 136. The guide portion 137 is formed so that the projection length at a portion located at one end of the main body portion 136 is maximal and the projection length gradually decreases toward the other end side of the main body portion 136. That is, when the fixed body 13*b* is arranged in the movable body 13*a*, the guide portion 137 is arranged at a location farthest from the coupling portions 132 and 133. The guide portion 137 is not formed in an area of the fixed body 13*b* corresponding to the coupling portions 132 and 133.

Since the fixed body 13*b* is able to rotate only with the drive shaft 3, the guide portion 137 does not approach the coupling portions 132 and 133 even if the rotation of the drive shaft 3 rotates the movable body 13*a* and the fixed body 13*b*. The movable body 13*a* thus relatively moves relative to the fixed body 13*b* in the direction of axis O while contacting the main body portion 136 and the guide portion 137 of the fixed body 13*b*.

As shown in FIG. 1, a third pin 47*c* connects the other radial side of the ring plate 45 to the coupling portion 132 of the movable body 13*a*. Although not shown, the coupling portion 133 has the same structure. The axis of the third pin 47*c* serves as an operation axis M3, and the movable body 13*a* supports the swash plate 5 to be tiltable about the operation axis M3. The operation axis M3 extends parallel to the first and second tilt axes M1 and M2. In this manner, the movable body 13*a* is coupled to the swash plate 5. The movable body 13*a* contacts the flange 3*a* when the inclination angle of the swash plate 5 is maximal.

A first recovery spring 44*a* is arranged between the fixed body 13*b* and the ring plate 45. The front end of the first recovery spring 44*a* is fixed to the rear surface 136*a* of the fixed body 13*b*. The rear end of the first recovery spring 44*a* is fixed to the other side of the ring plate 45.

As shown in FIG. 2, the control mechanism 15 includes a bleeding passage 15*a*, an air supply passage 15*b*, a control valve 15*c*, and an orifice 15*d*.

The bleeding passage 15*a* is connected to the pressure adjustment chamber 31 and the second suction chamber 27*b*. Thus, the bleeding passage 15*a*, the axial passage 3*b*, and the radial passage 3*c* connect the control pressure chamber 13*c*, the pressure adjustment chamber 31, and the second suction chamber 27*b*. The air supply passage 15*b* is connected to the pressure adjustment chamber 31 and the second discharge chamber 29*b*. The air supply passage 15*b*, the axial passage 3*b*, and the radial passage 3*c* connect the control pressure chamber 13*c*, the pressure adjustment chamber 31, and the second discharge chamber 29*b*. The orifice 15*d* is located in the air supply passage 15*b* to restrict the amount of refrigerant gas flowing through the air supply passage 15*b*.

The control valve 15*c* is arranged in the bleeding passage 15*a*. The control valve 15*c* adjusts the opening of the bleeding passage 15*a* based on the pressure in the second suction chamber 27*b* to adjust the amount of the refrigerant gas flowing through the bleeding passage 15*a*.

In the compressor, a pipe connects the evaporator to the suction port 330 shown in FIG. 1, and a pipe connects a condenser to the discharge port. The condenser is connected to the evaporator by a pipe and an expansion valve. The compressor, the evaporator, the expansion valve, the condenser, and the like form a refrigeration circuit of the vehicle air conditioner. The evaporator, the expansion valve, the condenser, and each pipe are not shown in the drawings.

In the compressor, the swash plate 5 is rotated and each piston 9 is reciprocated in the corresponding first and second cylinder bores 21*a* and 23*a* when the drive shaft 3 is rotated. Thus, displacement of the first and second compression chambers 21*d* and 23*d* are varied in accordance with the piston stroke. The refrigerant gas drawn into the swash plate chamber 33 from the evaporator through the suction port 330 flows through the first and second suction chambers 27*a* and 27*b* to be compressed in each of the first and second compression chambers 21*d* and 23*d* and is then discharged into the first and second discharge chambers 29*a* and 29*b*. The refrigerant gas in the first and second discharge chambers 29*a* and 29*b* is discharged out of the discharge port to the condenser.

During the operation of the compressor, a piston compression force that decreases the inclination angle of the swash plate 5 acts on a rotating body formed by the swash plate 5, the ring plate 45, the lug arm 49, and the first pin 47*a*. A change in the inclination angle of the swash plate 5 allows for displacement control to be executed by increasing and decreasing the stroke of the piston 9.

Specifically, in the control mechanism 15, when the control valve 15*c* shown in FIG. 2 increases the amount of the refrigerant gas flowing through the bleeding passage 15*a*, less refrigerant gas from the second discharge chamber 29*b* is accumulated in the pressure adjustment chamber 31 through the air supply passage 15*b* and the orifice 15*d*. Thus, the pressure of the control pressure chamber 13*c* becomes substantially equal to the second suction chamber 27*b*. As a result, the piston compression force acting on the swash plate 5 moves the movable body 13*a* toward the rear side of the swash plate chamber 33 in the actuator 13, as shown in FIG. 4B. In this case, the movable body 13*a* moves toward the rear side while contacting the inner surface of the circumferential wall 131, the circumference of the main body portion 136, and the guide portion 137 of the fixed body 13*b*. That is, the movable body 13*a* moves in the direction of axis O while being guided by the outer circumference of the main body portion 136 and the guide portion 137. Thus, the movable body 13*a* approaches the lug arm 49, as shown in FIG. 3, in the compressor.

Consequently, the lower side of the ring plate 45, that is, the lower side of the swash plate 5 is tilted in the counterclockwise direction about the operation axis M3 by the urging force of the first recovery spring 44*a*. One end of the lug arm 49 is tilted in the clockwise direction about the first tilt axis M1 and the other end of the lug arm 49 is tilted in the clockwise direction about the second tilt axis M2. Thus, the lug arm 49 approaches the flange 43*a* of the support 43. The swash plate 5 is thus tilted with the operation axis M3 functioning as the operation point and the first tilt axis M1 functioning as the fulcrum point. This decreases the inclination angle of the swash plate 5 relative to the rotation axis O of the drive shaft 3 and decreases the stroke of the pistons 9 thereby decreasing the suction and discharge displacement for each drive shaft rotation of the compressor. FIG. 3 shows the swash plate 5 at the minimum inclination angle in the compressor.

In the compressor, the centrifugal force acting on the weight 49*a* is also applied to the swash plate 5. Thus, in the compressor, the swash plate 5 can easily be moved in the direction that decreases the inclination angle. Further, the movable body 13*a* moves toward the rear in the swash plate chamber 33. This positions the rear end of the movable body 13*a* in the weight 49*a*. Thus, in the compressor, about one half of the rear end of the movable body 13*a* is covered by the weight 49*a* when the inclination angle of the swash plate 5 is decreased.

Further, the ring plate 45 contacts the front end of the second recovery spring 44*b* when the inclination angle of the swash plate 5 decreases. This elastically deforms the second recovery spring 44*b*, and the front end of the second recovery spring 44*b* approaches the support 43.

The refrigerant gas in the second discharge chamber 29*b* is easily accumulated in the pressure adjustment chamber 31 through the air supply passage 15*b* and the orifice 15*d* when the control valve 15*c* shown in FIG. 2 reduces the amount of the refrigerant gas flowing through the bleeding passage 15*a*. Thus, the pressure of the control pressure chamber 13*c* becomes substantially equal to the second discharge chamber 29*b*. In the actuator 13, the movable body 13*a* moves toward the front side of the swash plate chamber 33 while contacting the inner surface of the circumferential wall 131, the outer circumference of the main body portion 136, and the guide portion 137 of the fixed body 13*b*, as shown in FIG. 4A, against the piston compression force acting on the swash plate 5. In this case, the movable body 13*a* also moves in the direction of axis O while being guided by the outer circumference of the main body portion 136 and the guide portion 137. Thus, the movable body 13*a* moves away from the lug arm 49, as shown in FIG. 1, in the compressor.

Consequently, the movable body 13*a* pulls the lower side of the swash plate 5 toward the front side of the swash plate chamber 33 with the coupling portions 132 and 133 at the operation axis M3. The lower side of the swash plate 5 is thus tilted in the clockwise direction about the operation axis M3. One end of the lug arm 49 is tilted in the counterclockwise direction about the first tilt axis M1, and the other end of the lug arm 49 is tilted in the counterclockwise direction about the second tilt axis M2. The lug arm 49 thus moves away from the flange 43*a* of the support 43. Thus, the swash plate 5 tilts in the direction opposite to when the inclination angle is decreased with the operation axis M3 and the first tilt axis M1 respectively functioning as the operation point and the fulcrum point. This increases the inclination angle of the swash plate 5 relative to the rotation axis O of the drive shaft 3 thereby increasing the stroke of the piston 9 and increasing the suction and discharge displacement for each drive shaft rotation of the compressor. FIG. 1 shows the swash plate 5 at the maximum inclination angle in the compressor.

In this manner, in the compressor, the inner surface of the circumferential wall 131 of the movable body 13*a* contacts the outer circumference of the main body portion 136 and the guide portion 137 of the fixed body 13*b*. Thus, in the compressor, when the movable body 13*a* is moved back and forth in the direction of axis O by changes in the pressure of the control pressure chamber 13*c*, the movable body 13*a* moves while contacting the inner surface of the circumferential wall 131 and the outer circumference of the main body portion 136 and the guide portion 137. As a result, even if the suction reaction force and the compression reaction force acting on the pistons 9 are transmitted to the actuator 13 through the swash plate 5 and the link mechanism 7 in the compressor, the movable body 13*a* is moved in the direction of axis O while a predetermined inclination or greater of the movable body 13*a* relative to the drive shaft 3 is restricted. In the compressor, the actuator 13 is thus easily operated in a suitable manner and improves controllability for varying the compressor displacement.

In particular, in the compressor, the guide portion 137 is flanged to extend along the inner surface of the circumferential wall 131 of the movable body 13*a*, as shown in FIGS. 4A and 4B, to increase the area of contact between the inner surface of the circumferential wall 131 and the guide portion 137. Thus, in the compressor, when the movable body 13*a* moves, the guide portion 137 can suitably restrict a predetermined or greater inclination relative to the drive shaft 3 in the movable body 13*a*.

Further, in the compressor, the coupling portions 132 and 133 are formed at the other side of the movable body 13*a* to allow for easy coupling of the ring plate 45 and the movable body 13*a* and, consequently, the swash plate 5 and the movable body 13*a*. The guide portion 137 has a shape in which the projection length at one side of the main body portion 136, which is farthest from the coupling portions 132 and 133, is maximal and the projection length gradually decreases toward the coupling portions 132 and 133. Thus, in the compressor, the guide portion 137 is formed in an area excluding the area corresponding to the coupling portions 132 and 133. Thus, even if the compression reaction force is concentrated on the coupling portions 132 and 133 through the swash plate 5 thus deforming the coupling portions 132 and 133, the guide portion 137 is not affected by the force.

Further, as shown in FIG. 7, the slide layer 51 is formed on the outer surface of the main body portion 136 and the outer surface of the guide portion 137 of the fixed body 13*b* in the compressor. This decreases the slide resistance at the inner surface of the circumferential wall 131 and the outer circumference of the main body portion 136 and the guide portion 137 when the movable body 13*a* moves. Accordingly, the movable body 13*a* may be moved in a suitable manner by changing the pressure of the control pressure chamber 13*c* in the compressor. Further, as the slide resistance decreases, the durability of the movable body 13*a*, the fixed body 13*b*, and the guide portion 137 is improved in the compressor.

Accordingly, the compressor of the present embodiment has excellent controllability for varying the compressor displacement. Thus, it can be expected that the compressor displacement may be rapidly changed by the input to the control mechanism 15, and the response for displacement control may be increased in the compressor. Moreover, it may be expected that excellent durability of the compressor can be obtained even if the compressor displacement is frequently changed.

In particular, in the compressor, the guide portion 137 is formed on the rear surface 136*a* of the main body portion 136 and projected toward the swash plate 5 in the direction of axis O. Thus, the guide portion 137 does not project into the control pressure chamber 13*c* in the compressor. Therefore, in the compressor, the actuator 13 can be formed with the minimum size while ensuring sufficient volume for the control pressure chamber 13*c*. This allows for reduction in the size of the compressor.

Further, in the compressor, the opening of the bleeding passage 15*a* can be adjusted by the control valve 15*c* in the control mechanism 15. Thus, the driving feel of the vehicle may be maintained in a preferable manner by gradually decreasing the pressure of the control pressure chamber 13*c* with the low pressure of the second suction chamber 27*b* in the compressor.

It should be apparent to those skilled in the art that the present invention may be embodied in many other specific forms without departing from the spirit or scope of the invention. Particularly, it should be understood that the present invention may be embodied in the following forms.

The cylinder bores may be arranged in only one of the first cylinder block 21 and the second cylinder block 23, and each piston 9 may be provided with only one of the first piston head 9*a* and the second piston head 9*b*. In other words, the present invention may be applied to a variable displacement single-head swash plate compressor.

Further, the slide layer 51 may be formed on the inner surface of the circumferential wall 131 of the movable body 13*a*. Moreover, the slide layer 51 may be formed on the outer surface of the main body portion 136, the outer surface of the guide portion 137 of the fixed body 13*b*, and the inner surface of the circumferential wall 131.

In the control mechanism 15, the control valve 15*c* may be arranged in the air supply passage 15*b*, and the orifice 15*d* may be arranged in the bleeding passage 15*a*. In this case, the amount of the high pressure refrigerant flowing through the air supply passage 15*b* can be adjusted by the control valve 15*c*. Thus, the compressor displacement can be readily decreased by rapidly increasing the pressure of the control pressure chamber 13*c* with the high pressure of the second discharge chamber 29*b*.

The present examples and embodiments are to be considered as illustrative and not restrictive, and the invention is not to be limited to the details given herein, but may be modified within the scope and equivalence of the appended claims.

The invention claimed is:

1. A variable displacement swash plate compressor comprising:

a housing including a suction chamber, a discharge chamber, a swash plate chamber, and a cylinder bore;

a drive shaft supported to be rotatable in the housing;

a swash plate that is rotatable in the swash plate chamber when the drive shaft rotates;

a link mechanism arranged between the drive shaft and the swash plate, wherein the link mechanism allows an inclination angle of the swash plate to be changed relative to a direction orthogonal to a rotation axis of the drive shaft;

a piston reciprocated in the cylinder bore;

a conversion mechanism that reciprocates the piston in the cylinder bore with a stroke corresponding to the inclination angle when the swash plate rotates;

an actuator capable of changing the inclination angle; and a control mechanism that controls the actuator, wherein the actuator is arranged in the swash plate chamber to be rotatable integrally with the drive shaft, the actuator includes a movable body coupled to the swash plate, a fixed body fixed to the drive shaft, and a control pressure chamber defined by the movable body and the fixed body, the drive shaft is inserted into the movable body to allow movement of the movable body in an axial direction, the actuator is configured to move the movable body with an interior pressure of the control pressure chamber, the movable body includes a circumferential wall that extends in a direction along the rotational axis and surrounds the fixed body, the fixed body includes a main body portion and a guide portion, wherein the main body portion includes a first surface and a second surface, wherein the first surface of the main body portion is located closer to the swash plate, wherein the second surface of the main body portion is located closer to the control pressure chamber, wherein the guide portion projects in the direction along the rotational axis toward the swash plate from the first surface of the main body portion and extends along an inner surface of the circumferential wall, and the movable body contacts the guide portion to restrict inclination of the movable body relative to the drive shaft that is greater than or equal to a predetermined amount.

2. The variable displacement swash plate compressor according to claim 1, wherein the movable body includes a coupling portion that projects toward the swash plate and is coupled to the swash plate, and the guide portion is located in the fixed body at an area excluding an area corresponding to the coupling portion.

3. The variable displacement swash plate compressor according to claim 2, wherein the guide portion is flanged, the guide portion has a projection length that is maximal at a portion of the fixed body located farthest from the coupling portion, and the projection length gradually decreases toward the coupling portion.

4. The variable displacement swash plate compressor according to claim 1, further comprising a slide layer applied to at least one of the inner surface of the circumferential wall and the guide portion to reduce slide resistance.

* * * * *